United States Patent [19]

Strasser

[11] Patent Number: 5,056,319

[45] Date of Patent: Oct. 15, 1991

[54] REFRIGERATOR-OPERATED APPARATUS

[75] Inventor: Wilhelm Strasser, Bergisch-Gladbach, Fed. Rep. of Germany

[73] Assignee: Leybold Aktiengesellschaft, Fed. Rep. of Germany

[21] Appl. No.: 494,688

[22] Filed: Mar. 16, 1990

[30] Foreign Application Priority Data

Mar. 18, 1989 [DE] Fed. Rep. of Germany ..... 3008992

[51] Int. Cl.[5] ..... B01D 8/00

[52] U.S. Cl. ..... 62/55.5; 62/295; 248/636; 248/638

[58] Field of Search ..... 248/636, 638; 62/295, 62/296, 297, 55.5

[56] References Cited

U.S. PATENT DOCUMENTS

| | | | |
|---|---|---|---|
| 4,352,643 | 10/1982 | Iijima | 62/297 |
| 4,363,217 | 12/1982 | Venuti | 62/55.5 |
| 4,394,819 | 7/1983 | Averill | 248/638 |
| 4,539,822 | 9/1985 | Sunquist | 62/55.5 |
| 4,745,761 | 5/1988 | Bazaj et al. | 62/55.5 |
| 4,763,483 | 8/1988 | Olsen | 62/55.5 |
| 4,768,925 | 9/1988 | Geupel | 248/638 |
| 4,833,899 | 5/1989 | Tugal | 62/55.5 |
| 4,835,972 | 6/1989 | Tugal et al. | 62/55.5 |

*Primary Examiner*—Ronald C. Capossela

*Attorney, Agent, or Firm*—Hill, Van Santen, Steadman & Simpson

[57] ABSTRACT

A refrigerator-operated apparatus having a housing adapted to accept components to be cooled. The housing is connected to a refrigerator housing via a connecting pipe, and the refrigerator includes a refrigerator generator extending through the housing and the connecting pipe, and encompassing at least one refrigerator stage that carries the components to be cooled. The apparatus further includes a damping mechanism for inhibiting vibrations generated by the refrigerator from being transmitted to the housing. The damping mechanism includes a separation space dividing the refrigerator housing into first and second connecting sections, and an elastic connecting ring connecting the first section to the second section. In one embodiment, the connecting ring extends across the separation space and is surrounded by a cover tube. In a second embodiment, the connecting ring is secured directly to one of the connecting sections, and is secured to the other connecting section via an adaptor pipe. Detent structure may be provided between the adaptor pipe and one of the connecting sections to cause the connecting ring to be pre-stressed.

17 Claims, 1 Drawing Sheet

REFRIGERATOR-OPERATED APPARATUS

TECHNICAL FIELD

The invention is directed to a refrigerator-operated apparatus such as a cryogenic pump, cryostat, or the like, including a housing that accepts the component parts to be cooled, a refrigerator housing, a connecting pipe connecting the component housing to the refrigerator housing, and damping apparatus inhibiting vibrations generated by the refrigerator from being transmitted to the component housing.

BACKGROUND OF THE INVENTION

Refrigerators can be defined as temperature-cooling machines in which thermal dynamic cyclic processes occur (see, for example, U.S. Pat. No. 2,906,101). A "single-stage"refrigerator includes a single cylindrical work chamber encompassing a displacement member. The chamber is connected in alternation to high-pressure and low-pressure gas sources for predetermined periods, so that the desired thermal dynamic cyclic process (e.g., Stirling process or Gifford/McMahon process) occurs during reciprocation of the displacement member. As a consequence of this reciprocation, heat is withdrawn from a specific region of the work chamber. In two-stage refrigerators (having dual work chambers) employing such cyclic processes, temperatures down to about 10K can be generated using helium as a working gas in the work chamber.

Two-stage refrigerators are often used to operate cryogenic pumps and cryostats. In such devices, the cryogenic pump or cryostat usually includes a housing that receives component parts to be cooled. The refrigerator includes a housing that is connected to the component housing using a connecting pipe. The refrigerator may further include a refrigerating generator having at least one cylindrical work chamber (two in the case of a two-stage refrigerator) with a displacement member oscillating therein. The refrigerating generator extends through the refrigerator housing and the connecting pipe, into the component housing. The portion (usually the cold end) of the refrigerating generator that extends into the component housing carries a plurality of pump surfaces.

In a cryogenic pump operated with a two-stage refrigerator, the first, warmer refrigerator stage carries a pot-shaped pump surface that serves as a radiation shield for the pump surfaces of the second, colder stage. In the work chambers of the first and second refrigerator stages, the displacement members oscillate at a frequency that usually amounts to a few Hertz, for example 2 to 3 Hertz. This oscillation generates vibrations that may be transmitted from the refrigerator through the pump housing and eventually to a recipient connected to the pump housing. In many environments in which cryogenic pumps are commonly used (for example, in electron microscopes), such vibrations are particularly troublesome.

It has therefore already been proposed to provide damping structure that prevents vibrations from the refrigerator from being transmitted through the pump housing to the recipient. German OS No. 36 90 477 and U.S. Pat. No. 4,363,217 disclose damping structure that includes bellows systems combined with various damping agents (for example elastomers, damping material surrounding the bellows, wire suspension systems, and magnetic fields). Damping mechanisms of the type disclosed in these publications are relatively technically complex, and require excessive amounts of space.

European Application No. 19 426 discloses an apparatus in which a cryogenic pump is suspended from an associated recipient in a pendulum arrangement, using a spring bellows. This design, like those previously described, uses an expensive and delicate bellows. Furthermore, such an arrangement is ineffective when the displacement members of the refrigerator reciprocate or oscillate along the axis of distension of the spring bellows.

It can thus be seen that there exists a need for a refrigerator operated apparatus of the type described in which the cryogenic pump housing is coupled to the refrigerator housing with a structure that includes a simple, yet efficient, damping mechanism.

SUMMARY OF THE INVENTION

The present invention provides a refrigerator operated apparatus that solves the shortcomings of previously known arrangements by providing, between the housing of the cryogenic pump and the refrigerator housing, a generally cylindrical member that is separated into two substantially coaxial connecting sections by a separation space. The separation can occur in the refrigerator housing itself, or in a connecting pipe between the pump housing and the refrigerator housing. The connecting sections are connected to one another using an elastic connecting ring. In such an arrangement, the connecting ring performs two primary functions: first, it functions as a damping element; second, it provides a vacuum-tight connection between the two connecting sections. The connecting ring may be formed from an elastomeric material such as perbunane, polyurethane, or rubber (either natural rubber or silicone rubber). The material, however, should be selected such that vibrations generated by the refrigerator are not transmitted to the pump housing. In other words, the elastomeric properties of the material chosen should be adapted to the mass of the vibrating system.

Other objects and advantages of the present invention will become apparent upon reference to the accompanying description when taken in conjunction with the following drawings.

DESCRIPTION OF THE PREFERRED EMBODIMENTS

Figure 1:
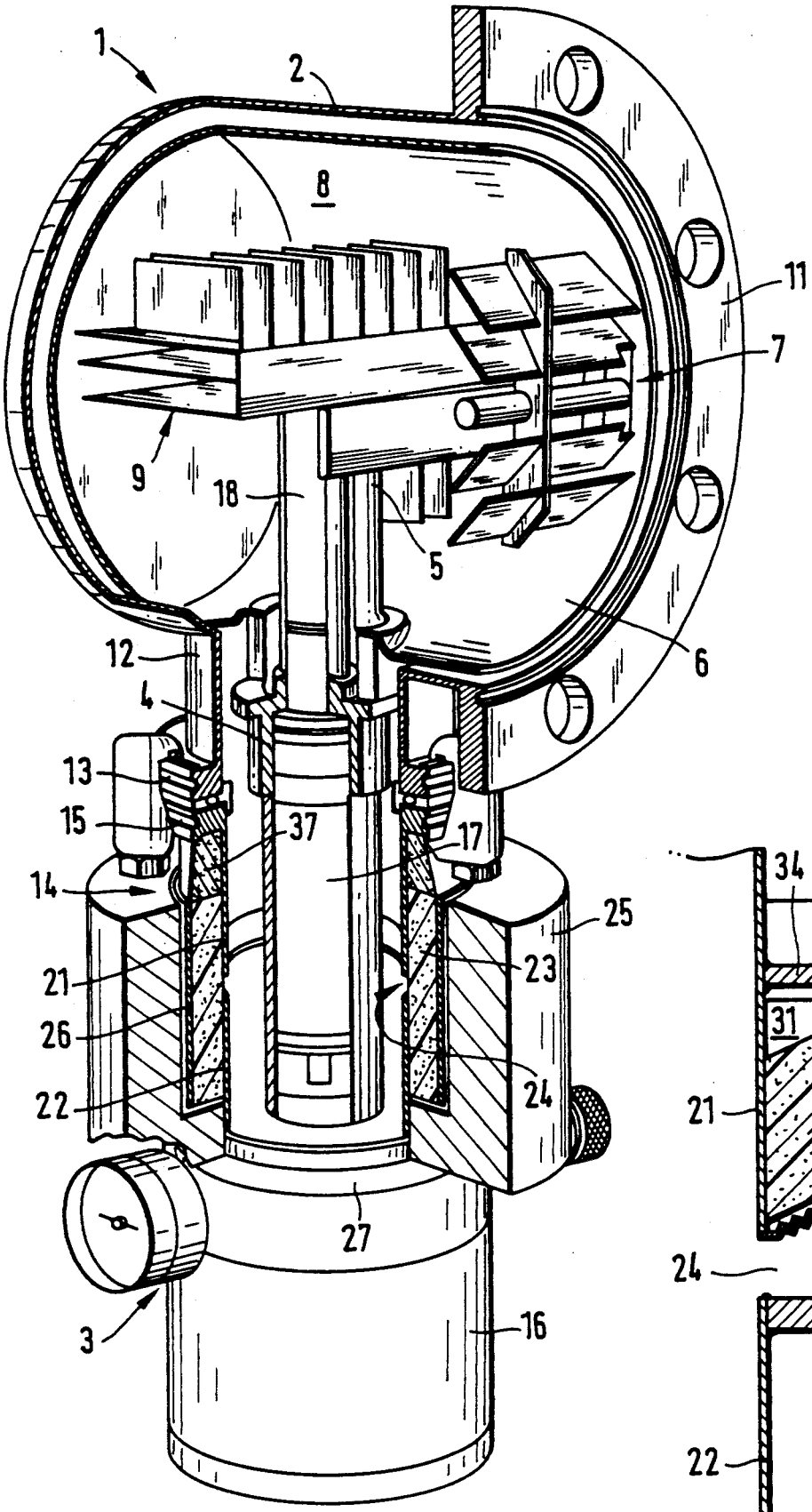
FIG. 1 is a sectional view of a cryogenic pump embodying the present invention.

FIG. 1 shows a cryogenic pump 1 having a pump housing 2 that is attached to a two-stage refrigerator 3. The refrigerator 3 includes a first, warmer stage 4 and a second, colder stage 5. A pot-shaped pump surface or enclosure 6 is secured in thermally conductive contact with the first refrigerator stage 4. The enclosure 6, along with a baffle assembly 7, defines an interior space 8 of the cryogenic pump 1. A plurality of pump surfaces 9 are secured in thermally conductive contact with the second refrigerator stage 5, and are located in the interior 8 of the cryogenic pump 1. The pump housing 2 is provided with a flange 11 that forms an entrance aperture for the cryogenic pump 1, at which a recipient (not shown) may be connected. A valve (not shown) may be interposed between the pump and the recipient.

During operation of the cryogenic pump 1, gases having relatively high boiling points agglomerate at the baffle 7 and the enclosure 6. Gases having lower boiling points (predominantly argon) and light gases (predominantly hydrogen) proceed through the baffle assembly 7 into the interior 8 of the cryogenic pump 1. The gases entering into the interior 8 are agglomerated at the pump surfaces 9.

The pump housing 2 is provided with a connecting pipe 12 that carries a flange 13. A cylindrical housing 14 of the refrigerator 3 includes a flange 15 that is secured in vacuum-tight engagement with the flange 13. The refrigerator stages 4 and 5 extend axially through the cylindrical refrigerator housing 14, through the connecting pipe 12, and into the interior 8 of the cryogenic pump 1.

In the illustrated embodiment, a control assembly 16 is disposed immediately beneath the refrigerator stages 4 and 5. The control assembly 16 serves to supply the work chambers with working gas in order to drive the respective displacement members 17, 18 of the refrigerator stages 4, 5. The working gas may be supplied with a compressor (not shown).

In the cryogenic pump 1 shown in FIG. 1, the housing 14 of the refrigerator 3 is divided into housing sections 21 and 22 joined together by a connecting ring 23 made of elastomeric material. The sections 21 and 22 are separated by a separation space 24 that occurs along the height of the first refrigerator stage 4. The annular connecting ring 23 is generally rectangular in cross section, and includes an inner annular surface that is connected to the sections 21, 22 by gluing or vulcanization. The outer surface of the connecting ring 23 is secured, also by gluing or vulcanization, to a cover tube 26. As a result of this arrangement, a "double-thrust" spring element is formed, and the ring 23 performs both damping and vacuum sealing functions. The vibrating unit of the cryogenic pump 1 (including, for example, refrigerator stages 4 and 5 of the refrigerator 3, the control assembly 16, the pump surfaces 6 and 8, and the baffle assembly 7) are vibrationally isolated from the housing section 21 by the connecting ring 23. Consequently, vibrations generated by operation of the refrigerator 3 are inhibited from being transmitted to the pump housing 2 of the cryogenic pump 1. Alternatively, the connecting pipe 12 could be divided into two sections by a separation space 24, and provided with structure similar to connecting ring 23 and cover tube 26.

The damping effect of the ring 23 depends upon certain characteristics of the ring itself. For example, the elasticity and damping effect of the ring depends on the material from which it is made, and the spring stiffness of the ring depends upon geometrical design. The damping effect of the connecting ring 23 also depends upon the mass of the vibrating portions of the cryogenic pump. The natural frequency of the vibrating unit is reduced by increasing the mass, and vibration transmission is minimized, given the equation:

$$(W/W_c) \leqq 1$$

where:

W equals the frequency of the oscillating displacement members; and $W_c$ equals the natural frequency of the vibrating unit.

For these reasons, it may therefore be advantageous to equip the vibrating unit of the pump with an auxiliary weight 25, as shown in FIG. 1. The auxiliary weight 25 is annular, and surrounds (but does not contact) the connecting ring 23 and the cover tube 26. The auxiliary weight 25 is supported on a flange 27 at a lower section 22 of the refrigerator housing 14, and thus may be considered to be part of the vibrating unit of the cryogenic pump 1. An auxiliary weight of this type is relatively space efficient, and is especially advantageous when the control assembly 16 for the cryogenic pump 1 is disposed at a location remote from the other pump components.

Figure 2:
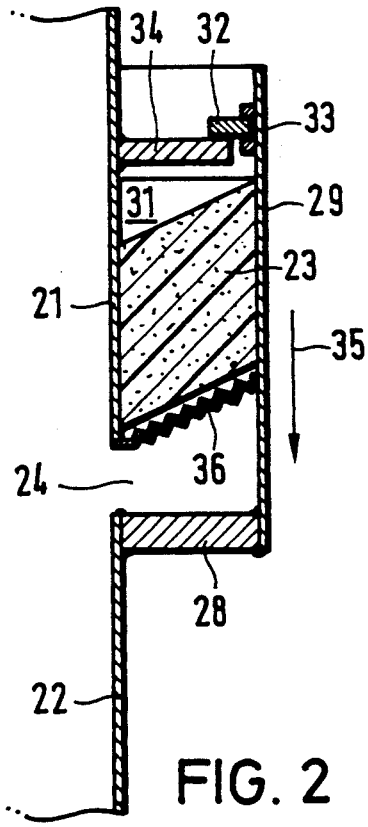
FIG. 2 is a sectional view, partially broken away, of a second embodiment of the invention.

In the embodiment shown in FIG. 2, the lower section 22 of the refrigerator housing 14 is provided with an outwardly extending annular disc 28 adjacent the separation space 24. The annular disc 28 serves to secure the lower section 22 to an adaptor pipe 29 that concentrically surrounds the upper housing section 21 of the refrigerator housing 14. A connecting ring 23 is disposed in an annular space 31 between the housing section 21 and the adaptor pipe 29. The connecting ring 23 is secured to the outer surface of the connecting section 21, and to the inner surface of the adaptor pipe 29, either by gluing or by vulcanization. During operation of the cryogenic pump, the connecting ring 23 is subjected to shearing forces. Optimal spring and damping properties of the connecting ring 23 can be achieved with suitable selection of the ring material and ring height.

When the cryogenic pump 1 is in an inoperative state, the connecting section 21 and the adaptor pipe 29 assume the relative positions shown in FIG. 2. In this position, a clamp ring 32 is provided on an inside groove 33 on the inside of the adaptor pipe 29. Adjacent to the clamp ring 32, an annular disc 34 is secured (for example, by welding) to the outside surface of the connecting section 21. The contact between the clamp ring 32 and the annular disc 34 limits the downward displacement of the vibrating unit of the cryogenic pump 1. Such displacement occurs due to the spring bias of the connecting ring 23 exerted in the direction of arrow 35. The clamp ring 32 and the annular disc 34 thereby pre-stress the connecting ring 23 at about 80 to 90% of the vacuum force accompanying complete evacuation of the refrigerator housing.

During operation of the cryogenic pump 1, a vacuum is generated within the pump housing 2. When the force of the vacuum exceeds the pre-stress forces on the connecting ring 23, a gap forms between the clamp ring 32 and the annular disc 34. This gap is of sufficient width to prevent vibrations of the vibrating unit from causing the clamp ring and the annular disc to strike one another. Due to the pre-stressing of the connecting ring 23, the vacuum force required to separate the clamp ring 32 and the annular disc 34 is extremely small, and thus the connecting ring 23 may be fabricated from an extremely soft material.

It may also be desirable to provide additional structure for damping vibrations. In order to be effective, such structure should be supported between the vibrating unit and stationary portions of the cryogenic pump. In the exemplary embodiment shown in FIG. 1, such additional damping structure is provided in the form of a ring 37. The ring 37 may be made from metal wool, and is shown between the stationary flange connection 13/15, and the upper edge of the connecting ring 23. The ring 37 is structurally simple, takes up little space, and contributes to damping of vibrations.

In the exemplary embodiment of FIG. 2, an essentially annular membrane 36 is provided adjacent the underside of the connecting ring 23. The inside edge of the membrane 36 is secured to the connecting section 21, and the outer edge of the membrane 36 is secured to the adaptor pipe 29. The membrane 36 may be secured in place by welding, and serves to protect the elastomeric material of the connecting ring 32 against corrosive gases that may be present in the pump.

Although the present invention has been described with reference to a specific embodiment, those of skill in the art will recognize that changes may be made thereto without departing from the scope and spirit of the invention as set forth in the appended claims.

I claim as my invention:

1. In a refrigerator-operated apparatus having an apparatus housing adapted to accept components to be cooled, said apparatus housing being mechanically connected to a refrigerator housing of a refrigerator unit via a connecting pipe, said refrigerator unit including a refrigerator generator extending through said housing and said connecting pipe and encompassing at least one oscillatory assembly adapted to carry said components to be cooled, said refrigerator housing and said connecting pipe forming a vibration-transmitting unit, the improvement of a means for inhibiting transmittal of vibrations from said refrigerator unit to said apparatus housing via said vibration-transmitting unit, said improvement comprising:

said vibration-transmitting unit having a separation space dividing said vibration-transmitting unit into first and second connecting sections; and an elastic ring disposed adjacent said separation space connecting said first connecting section to said second connecting section and inhibiting transmittal of vibrations therethrough.

2. An apparatus according to claim 1, wherein said connecting ring of said damping means comprises the following:

a radially inner surface surrounding and secured to said first and second connecting sections and extending longitudinally across said separation space; and a radially outer surface surrounded by a cover tube.

3. An apparatus according to claim 1, wherein said damping means further comprises the following:

an adaptor pipe concentrically surrounding and attached to said first connecting section and forming an annular space between aid adaptor pipe and said second connecting section;

said connecting ring being secured to said adaptor pipe and to said second connecting section, and disposed in said annular space.

4. An apparatus according to claim 3, further comprising a detente means for limiting relative movement between said adaptor pipe and said first connecting section.

5. An apparatus according to claim 4, wherein said detente means comprises the following:

a clamp ring secured to an inner surface of said adaptor pipe;

an annular disc secured to an outer surface of said first connecting section; and selective contact between said clamp ring and said annular disc limits an extent of relative movement between said adaptor pipe and said first connecting section, thus causing said connecting ring to be pre-stressed.

6. An apparatus according to claim 1, wherein said refrigerator is provided with auxiliary weight means for reducing vibration.

7. An apparatus according to claim 6, wherein said auxiliary weight means comprises an annular weight surrounding said connecting ring.

8. An apparatus according to claim 1, wherein said connecting ring comprises a surface facing toward the interior of said refrigerator housing, and further wherein said surface of said connecting ring is covered with a membrane.

9. An apparatus according to claim 1, wherein said connecting ring is formed from a material selected from a group consisting of perbunane, rubber, and polyurethane.

10. An apparatus according to claim 1, wherein said connecting ring is secured by gluing or vulcanizing.

11. An apparatus according to claim 1, further comprising additional means, disposed between said damping means and said housing, for further inhibiting vibrations generated by said refrigerator from being transmitted to said housing.

12. An apparatus according to claim 1, wherein said apparatus comprises a cryogenic pump, and said refrigerator includes a first stage to which is secured, in thermally conductive contact, a pot-shaped enclosure, said refrigerator including a second stage extending into said enclosure and to which are secured, in thermally conductive contact, a plurality of pump surfaces, and wherein said separation space and said connecting ring are disposed adjacent an upper end of said first refrigerator stage.

13. In a refrigerator-operated apparatus including an apparatus housing adapted to accept components to be cooled, and a refrigerator unit mechanically connected to said apparatus housing, an arrangement for inhibiting transmission of vibrations between said refrigerator unit and said apparatus housing, said arrangement comprising:

a generally cylindrical member connecting said refrigerator unit to said apparatus housing, said generally cylindrical member having a separation space dividing said generally cylindrical member into two substantially coaxial sections; and an elastic connecting ring disposed adjacent said space and connecting said sections together to prevent transmission of vibration between said refrigerator unit and said apparatus housing.

14. An arrangement according to claim 13, wherein said connecting ring is secured to each of said sections and extends across said separation space.

15. An apparatus according to claim 13, further comprising:

an adaptor pipe concentrically surrounding said sections and said separation space, said adaptor pipe being secured directly to a first one of said sections;

said connecting ring being secured to an outer surface of a second one of said sections and to an inner surface of said adaptor pipe.

16. An apparatus according to claim 15, further comprising a detente means for limiting relative movement between said adaptor pipe and said first connecting section.

17. An apparatus according to claim 16, wherein said detente means comprises the following:

a clamp ring secured to an inner surface of said adaptor pipe;

an annular disc secured to an outer surface of said first connecting section; and selective contact between said clamp ring and said annular disc limits an extent of relative movement between said adaptor pipe and said first connecting section, thus causing said connecting ring to be pre-stressed.

* * * * *